US009585815B2

(12) United States Patent
Tesini et al.

(10) Patent No.: US 9,585,815 B2
(45) Date of Patent: Mar. 7, 2017

(54) PACIFIER FOR USE WITH PREMATURE NEWBORNS AND INFANTS

(76) Inventors: David Tesini, Hopkinton, MA (US); Joshua Wiesman, Boston, MA (US)

( * ) Notice: Subject to any disclaimer, the term of this patent is extended or adjusted under 35 U.S.C. 154(b) by 156 days.

(21) Appl. No.: 13/036,412

(22) Filed: Feb. 28, 2011

(65) Prior Publication Data

US 2011/0218569 A1 Sep. 8, 2011

Related U.S. Application Data

(60) Provisional application No. 61/308,397, filed on Feb. 26, 2010.

(51) Int. Cl.
*A61J 17/00* (2006.01)
*A61J 7/00* (2006.01)

(52) U.S. Cl.
CPC ..... *A61J 17/001* (2015.05); *A61J 7/0053* (2013.01); *A61J 17/006* (2015.05)

(58) Field of Classification Search
CPC ..... A61J 17/00; A61J 2017/001; A61J 2017/008; A61J 11/00; A61J 11/0035; A61J 11/004; A61J 11/006; A61J 11/0065; A61J 11/007
USPC ..... 606/234–236; D24/194; 215/11.1–11.6
See application file for complete search history.

(56) References Cited

U.S. PATENT DOCUMENTS 3,924,621 A * 12/1975 Cassimally ..... 606/236
4,403,613 A * 9/1983 Panicci ..... 606/236
5,078,733 A 1/1992 Eveleigh et al.
5,133,740 A * 7/1992 Kussick ..... 606/236
5,275,619 A * 1/1994 Engebretson et al. ..... 606/236
5,300,089 A 4/1994 Sassin
5,743,648 A 4/1998 Zeindler
5,922,010 A 7/1999 Alanen et al.
6,564,416 B1 5/2003 Claire et al.
6,776,157 B2 * 8/2004 Williams et al. ..... 128/203.12
6,863,681 B2 * 3/2005 Dickerson ..... A61J 17/02 606/234
7,144,416 B2 * 12/2006 Struckmeier et al. ..... 606/236
D563,106 S 3/2008 Chan et al.
7,594,293 B2 9/2009 Xi et al.
7,731,733 B2 6/2010 Tesini et al.
7,789,894 B2 9/2010 Rohrig
2008/0188894 A1 * 8/2008 Hakim ..... 606/236
2009/0005810 A1 1/2009 Bonazza

OTHER PUBLICATIONS

International Search Report and Written Opinion of International Searching Authority mailed Jun. 29, 2012 in corresponding PCT application No. PCT/US12/26037.

* cited by examiner

*Primary Examiner* — Diane Yabut
*Assistant Examiner* — Martin T Ton
(74) *Attorney, Agent, or Firm* — Brian M. Dingman; Dingman IP Law, PC

(57) ABSTRACT

A pacifier for use with premature newborns and infants. The pacifier has a shield and a hollow bulb projecting from one side of the shield, the bulb defining a generally rectangular cross-sectional profile or internal shape along at least a portion of its length from the shield to its distal free end.

17 Claims, 13 Drawing Sheets

PACIFIER FOR USE WITH PREMATURE NEWBORNS AND INFANTS

CROSS-REFERENCE TO RELATED APPLICATION

This application claims priority of Provisional Patent Application Ser. No. 61/308,397 filed on Feb. 26, 2010.

FIELD

This disclosure relates to a pacifier.

BACKGROUND

Once an infant begins to turn its head with neck extension, suckling becomes an active oral pattern with large up and down, forward/back and lateral or excursive movements of the jaw; and rhythmic peristaltic forward/back movement of a cupped tongue. The newborn's respiratory function is characterized by obligatory nasal breathing because of the close approximation of the tongue to the soft palate which can obstruct oral airway patency.

SUMMARY

This invention features in one embodiment a pacifier for use with premature newborns and infants comprising a shield and a hollow bulb projecting from one side of the shield, the bulb defining a generally rectangular cross-sectional profile along at least a portion of its length from the shield to its distal free end.

This embodiment optionally includes one or more of the following features. The bottom side of the bulb can define one or more depressions to guide the tongue during swallowing. The longitudinal axis of the bulb can be tipped upward such that it is higher at the distal end of the bulb than it is at the base of the bulb. The shield may be flexible and/or it may be angled relative to the bulb and/or angled away from the chin toward its lower portion, all of which helps to allow the mandible to move forward thus opening the airway for better breathing. The pacifier is preferably made by injection molding of a 50-65 Shore A Medical Grade silicone or equivalent material. Wall thicknesses of the pacifier will typically range from about 1 mm to about 1.5 mm to meet current U.S. and international safety codes. The preferred embodiment has a nominal 1.5 mm wall thickness, but may vary. The pacifier can be molded in a single shot, or the nipple or bulb may be molded as one stage and the shield portion over molded as a second stage.

This embodiment optionally includes one or more of the following additional features. The bulb shape may encourage sucking, swallowing and breathing and coordination thereof. The pacifier may include a flexible handle that bends or collapses when the child rolls onto it, to help prevent a choking hazard while maintaining an open airway. The handle can be used by the caregiver to guide, place or retrieve the pacifier. The pacifier may include a hard plastic ring molded into a soft silicone (or equivalent) shield allowing for a more contoured shield and also more open areas for venting the skin/cheeks. The tip of the bulb may be open and designed to be interference fitted with an intubation tube or other tool/instrument.

BRIEF DESCRIPTION OF THE DRAWINGS

FIGS. 5-10 are views of a preferred embodiment: FIGS. 5 and 6 are perspective views showing the bulb of a preferred embodiment. FIG. 8 is a vertical section through the center of the pacifier. FIG. 9 is a horizontal midline section looking from the bottom to the top. FIG. 10 is a highly schematic cross-sectional view of the bulb in place against the palate, illustrating one aspect of its functionality.

BRIEF DESCRIPTION OF THE SEVERAL VIEWS OF THE DRAWINGS

Figure 3A:
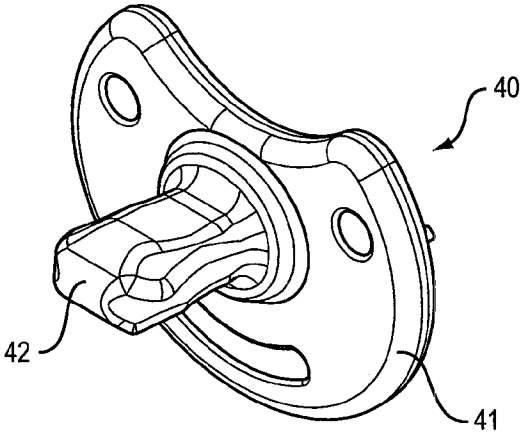
Figure 3B:
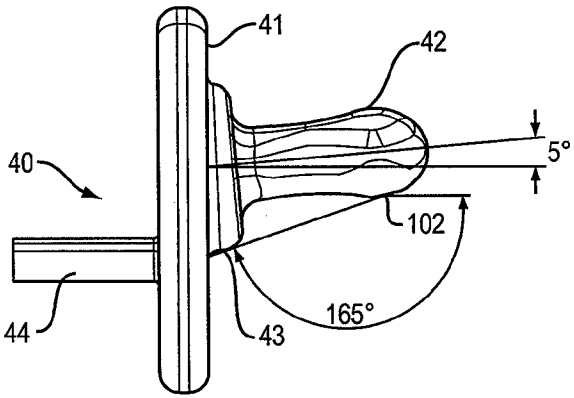
Figure 3C:
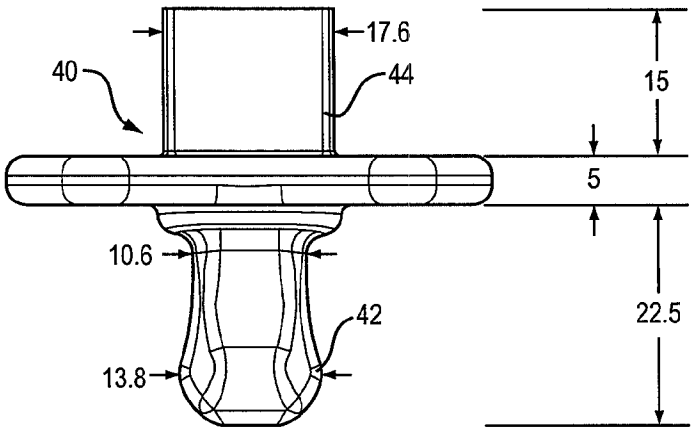
Figure 3D:
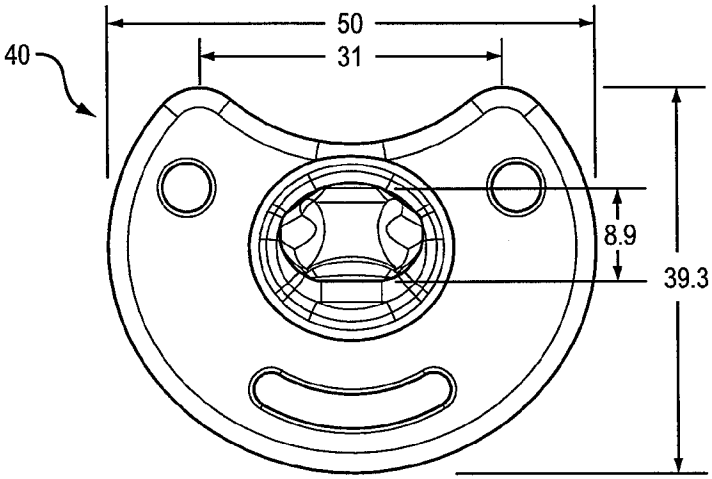
Figure 4:
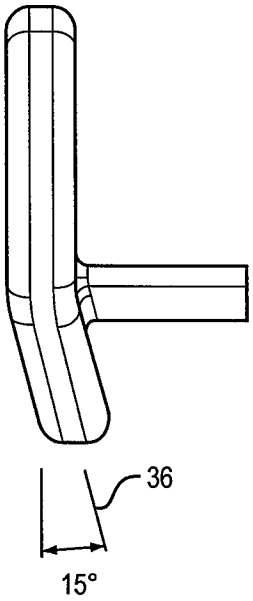
FIG. 4 illustrates an angled lower shield portion of a pacifier.

Preferred embodiments of the invention are shown in the drawings. FIGS. 1A-1D and 2A-2D are various views (with preferred dimensions in millimeters) of embodiments that are most useful for infants of gestational ages 34 weeks and older. Another embodiment for infants of gestational age 28 plus weeks is shown in FIGS. 3A-3D. The embodiments of FIGS. 1-3 are largely the same in terms of their external and internal shape and construction, and differ mainly in their dimensions. FIG. 4 shows the angled lower shield portion of one non-limiting embodiment.

Figure 5:
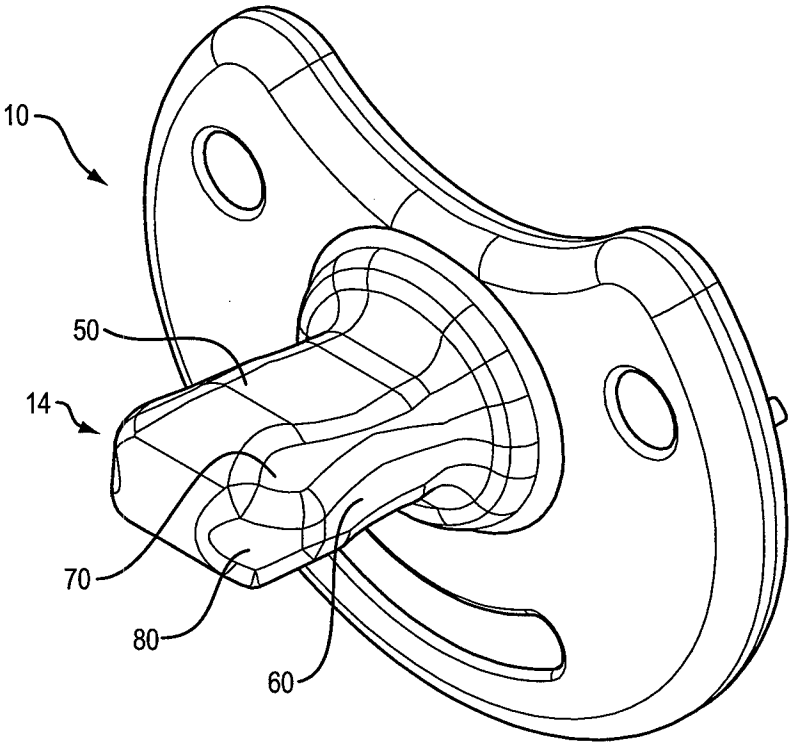
Figure 6:
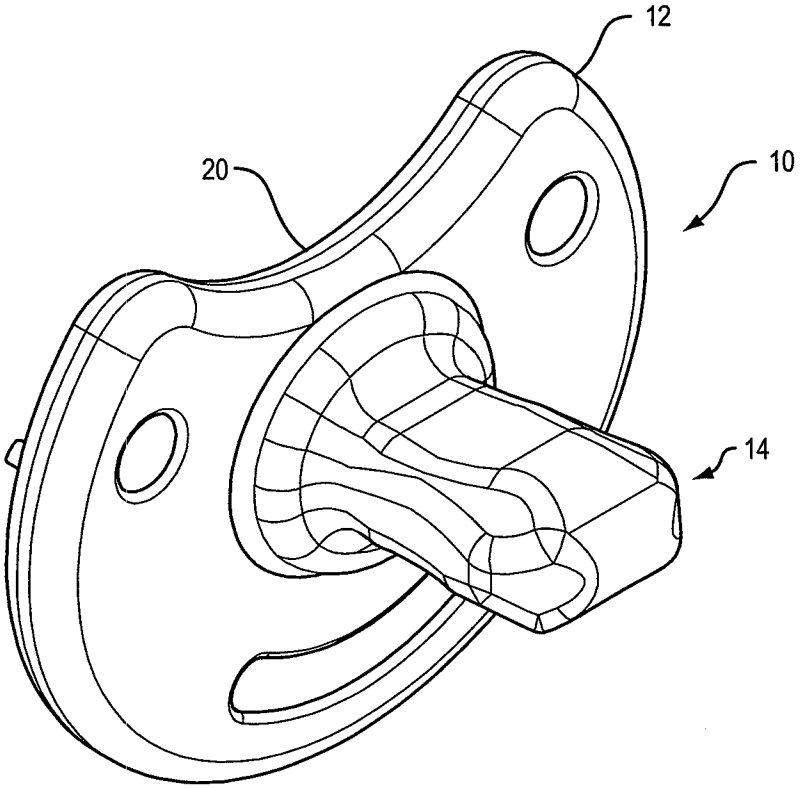
Figure 7A:
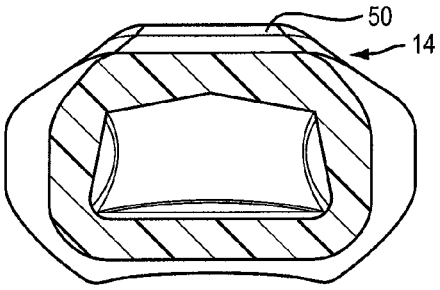
FIGS. 7A-7F are vertical sections through this bulb at different distances from the shield toward the distal tip, looking toward the tip.
Figure 7B:
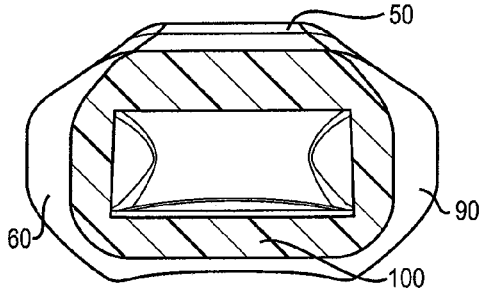
Figure 7C:
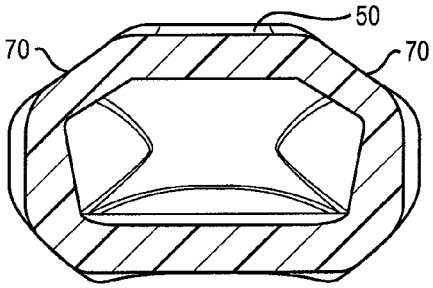
Figure 7D:
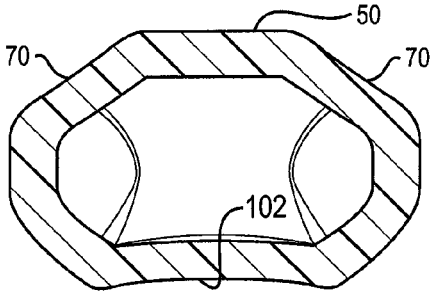
Figure 7E:
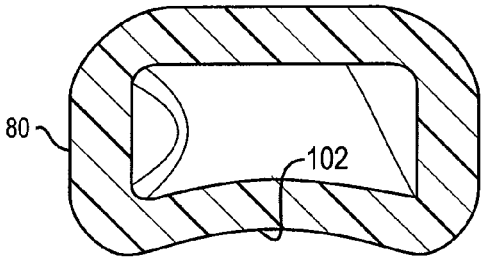
Figure 7F:
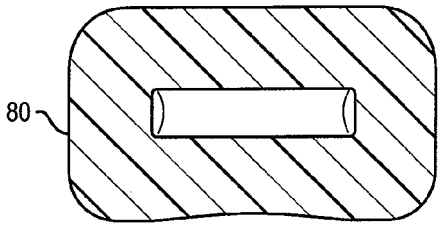
Figure 8:
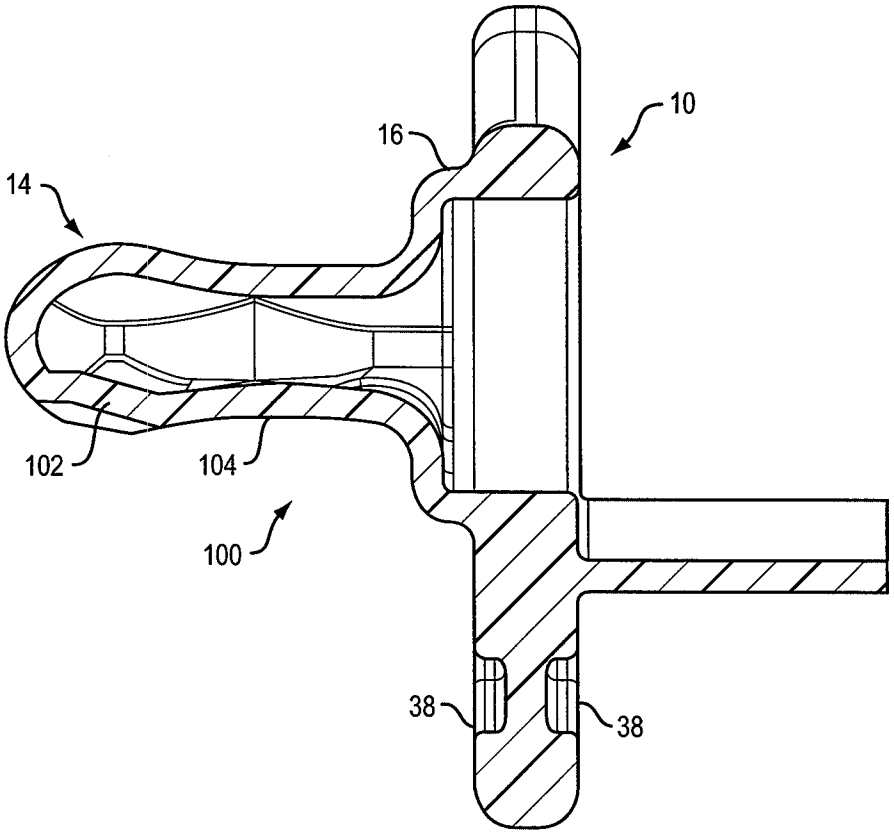
Figure 9:
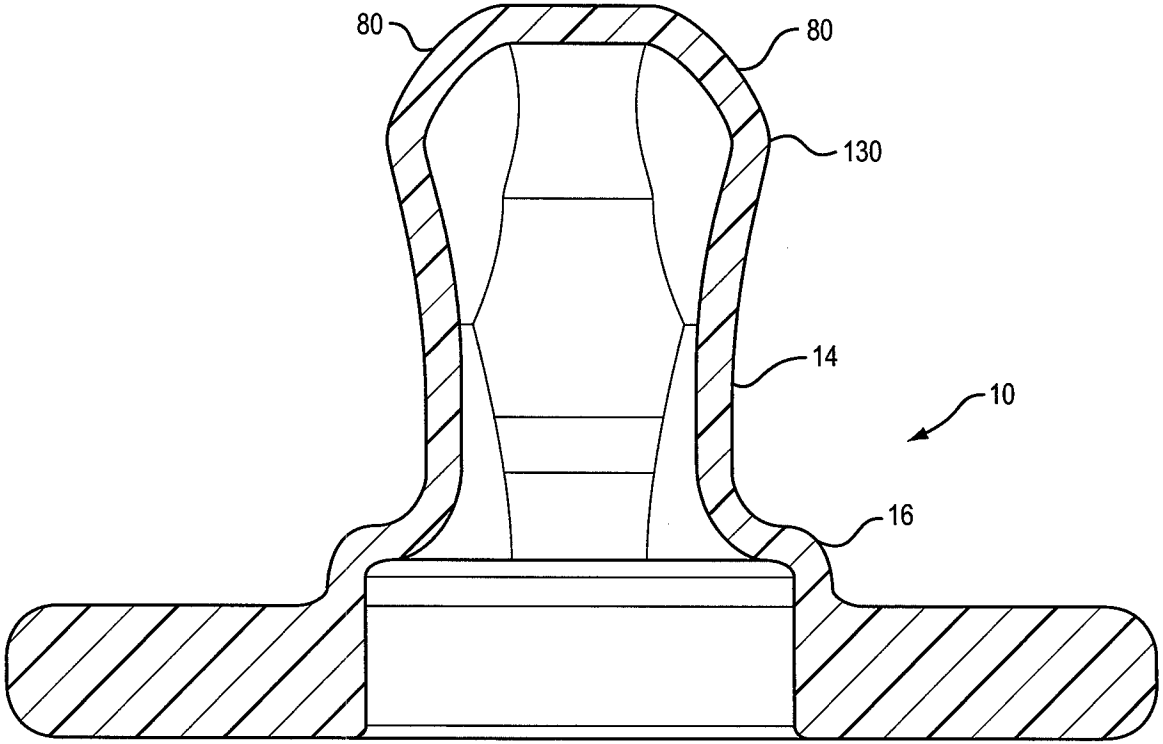
Figure 10:
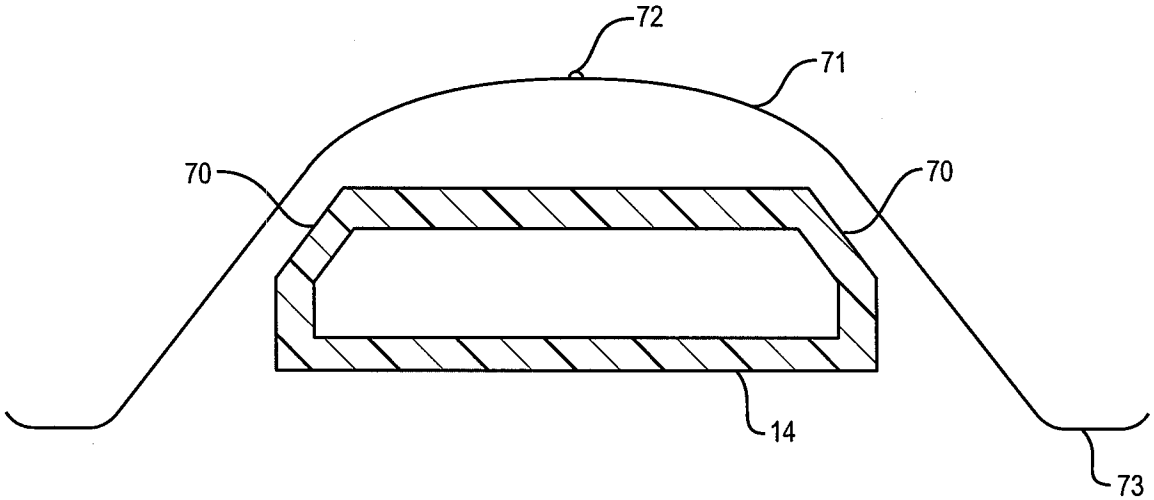

FIGS. 5-10 are views of a preferred embodiment. FIGS. 5 and 6 are perspective views showing the bulb of a preferred embodiment. FIGS. 7A-7F are vertical sections through this bulb at different distances from the shield toward the distal tip, looking toward the tip, showing the generally rectangular cross-sectional shape and other aspects of the shape. The distances from the shield are 6 mm, 10 mm, 15 mm, 18 mm, 20 mm and 21 mm, respectively. FIG. 8 is a vertical section through the center of the pacifier. FIG. 9 is a horizontal midline section looking from the bottom to the top. FIG. 10 is a highly schematic cross-sectional view of the bulb in place against the palate, illustrating one aspect of its functionality.

DETAILED DESCRIPTION OF THE INVENTION

Figure 1A:
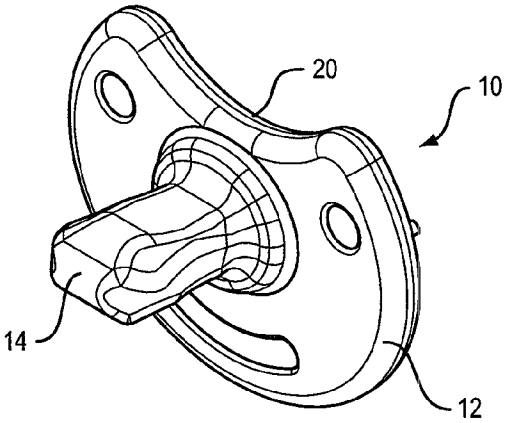
FIGS. 1A-1D, 2A-2D and 3A-3D illustrate three similar embodiments of the pacifier.
Figure 1B:
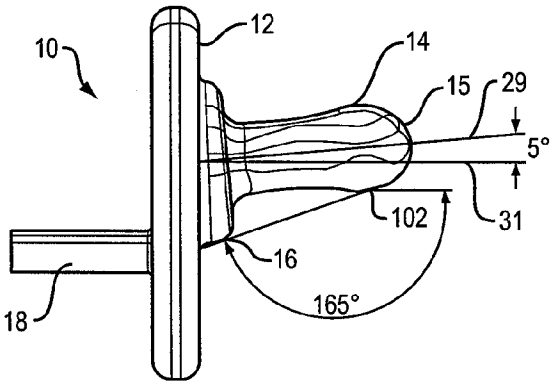
Figure 1C:
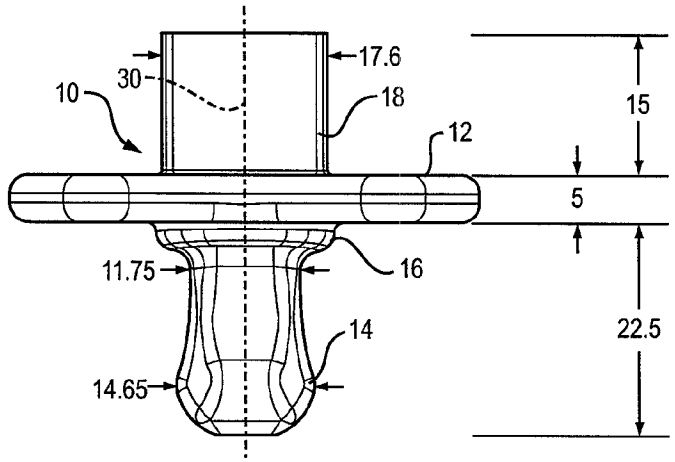
Figure 1D:
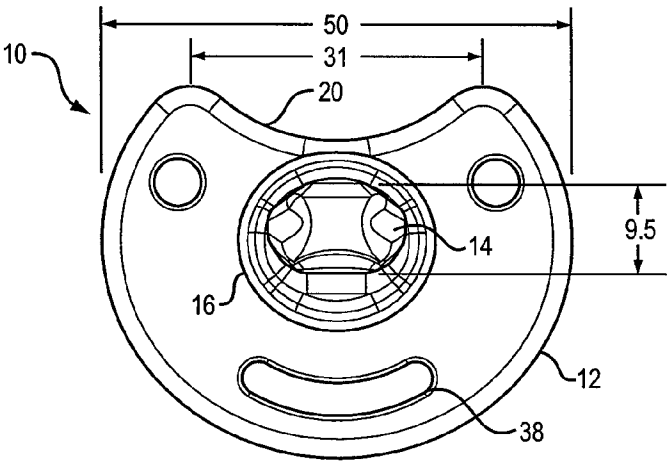
Figure 2A:
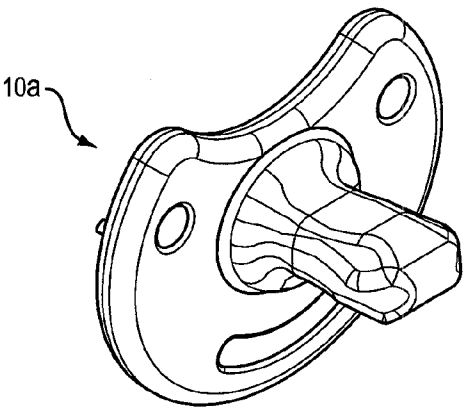
Figure 2B:
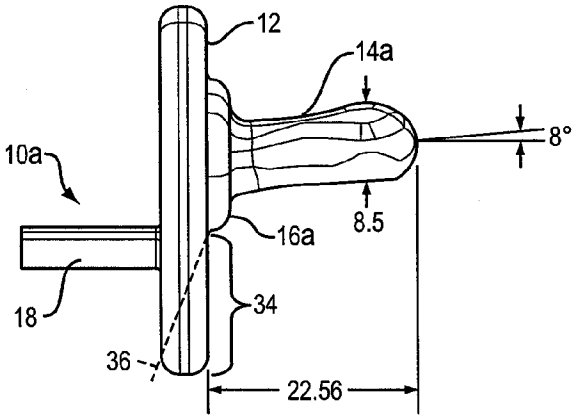
Figure 2C:
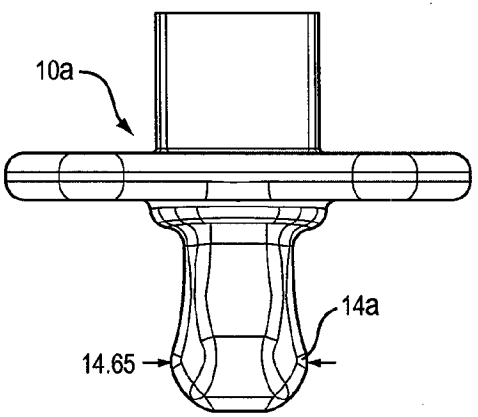
Figure 2D:
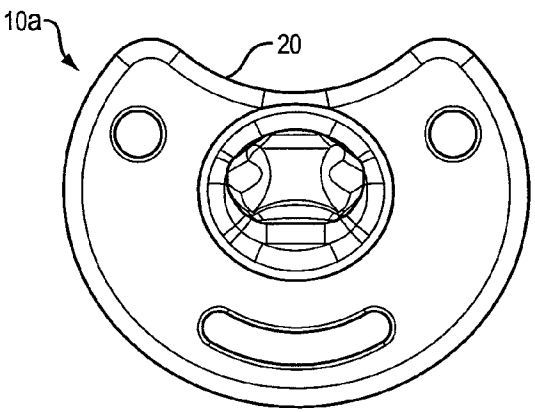

Shield 12 of pacifier 10, FIGS. 1A-1D, preferably defines a generally circular circumference or contour, with a generally partially-circular depression or cutout 20 at the top, above the hollow bulb. Area 20 spans the width of the shield and is depressed to a location very close to the base of the bulb. This provides room for a nasal cannula that would not be interfered with by the pacifier. Pedestal or raised area 16 defines a transition region between shield 12 and bulb 14. Pedestal 16 can be thicker toward the bottom as shown in FIG. 1B so as to create a distal face that is angled relative to the face of shield 12. If the bulb axis is normal to the face of the pedestal, the pedestal thus defines the angle of the bulb relative to the shield. Another feature of the pacifier is the solid arc-shaped soft projecting blade-type handle 18 that provides a means for a caregiver to hold and manipulate the pacifier.

Bulb 14 defines several functional features. For one, the central longitudinal axis 29 of bulb 14 is tilted upward with respect to the surface of shield 12 such that axis 29 lies at about a five to eight degree angle to horizontal 31 that is normal to the surface of shield 12 (five degrees in bulb 14, FIG. 1 and eight degrees in bulb 14*a*, FIG. 2). This angle moves the lower portion 34 of shield 12 slightly away from the chin, which takes pressure off the chin to allow for normal mandibular positioning. This also allows for forward motion of the mandible that enhances opening of the airway. Additional means to assist in this functionality can be accomplished by angling lower shield portion 34 such that it angles away from the chin (e.g., it follows axis 36). As shown in FIG. 4, this angle is preferable 15 degrees from the plane of the shield, although any angle greater than zero degrees would assist and the angle could be increased as long as it did not affect other functionalities of the pacifier. In the embodiment of FIG. 4 the angle begins about 10 mm below the center of the nipple. A desired flexibility of lower portion 34 of shield 12 (to allow for mandible positioning and movement) can also be accomplished by making portion 34 thinner, or of a different material, and/or by including depressions 38 (FIG. 8) in this lower portion. Depressions 38 may be arc-shaped, but need not be. Depressions 38 cause a thinning and thus a weakening that accomplishes or at least augments the desired flexibility.

The shape of the bulb of the preferred embodiment is detailed in many of the drawings. In general, through its wall shape and configuration and the shapes of its internal and/or external surfaces the bulb helps to gently support the arch while encouraging sucking, swallowing and breathing and the coordination of these three bodily functions in the premature infant. Bulb 14 is bilaterally symmetric about vertical mid plane 30. The top or dorsal surface 50 of bulb 14 is typically flat or generally flat and sufficiently wide to accommodate and gently support the palatal arch form so as to enhance palatal development. The shape, size and width of dorsal surface 50 can be varied to accomplish a desired amount of contact with the arch, desired contact locations, and desired stiffness and support. A smaller contact area may allow for more normal saliva flow, thus encouraging important physiologic behaviors and development.

In this embodiment, angled areas 70 located toward the distal tip where the top 50 and lateral surfaces 60 merge into one another create surfaces that also help to support the arch 71 as shown in FIG. 10. Areas 70 can also be used to vary the width of area 50 and thus the amount of and locations of tissue contact. Contact of area 50 with the arch can also be decreased by depressing or cupping portions of it, or adding a longitudinal groove to it, for example.

Due at least in part to its generally rectangular cross-section, bulb 14 is fairly rigid in compression resulting from forces on sides 60 and areas 70. The bulb thus inhibits movement of the arch 71 about the suture 72 so as to encourage normal arch development. Bulb 14 in this sense acts like a hollow structural section spanning the arch, and so helps to maintain normal physiology even during a sucking action in which muscular forces otherwise would tend to collapse the arch and the alveolar ridge 73 inward toward the vertical plane of the palatal suture.

Lateral surfaces 60 also help to allow for normal volumetric expansion of the bulb during peristalsis. This enhances the sensory stimulation for accelerated tongue strength and physiologic tongue reflex control. Bottom or lingual surface 100 defines near distal tip 15 a depression 102 that helps to guide and place the tongue. This depression allows for more normal tongue movement to help to develop the efficiency of early and late peristaltic movement. This further enhances the sensory stimulation for increased functional tongue strength and physiologic tongue reflex control. As shown in FIGS. 1B and 3B, the surface of depression 102 preferably defines an angle of about 165 degrees with the horizontal. Depression 104 located more proximally than depression 102 can also assist with this functionality by allowing the tongue to move forward as if it were accepting a mother's nipple/breast.

Anterior lateral tip surfaces 80 are angled inward from widest section 130. These areas allow for stretching and flexing of the tip and again simulation for the child to learn to accept new surfaces/textures, essential when accepting the breast and/or later on in accepting foods.

Figure 11A:
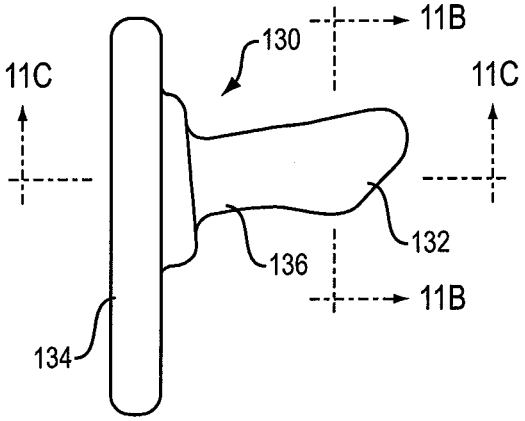
FIGS. 11A-11C show another embodiment with a bulb with an external shape that is more rounded than that of the embodiments shown in FIGS. 1-10.
Figure 11B:
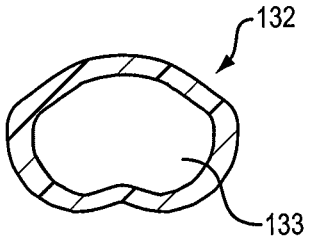
Figure 11C:
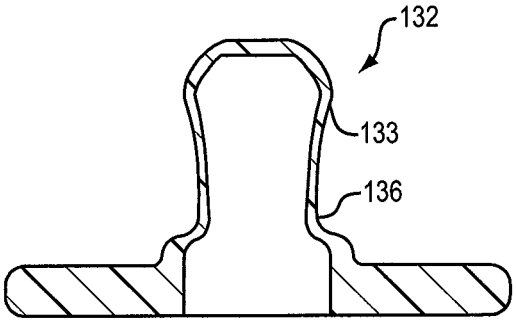

FIGS. 11A-11C show another embodiment of nipple 130 with a bulb with an external shape that is more rounded like a conventional orthodontic pacifier than that of the embodiments shown in FIGS. 1-10. Nipple 130 comprises bulb 132, neck 136 and base 134 that would be connected to the shield, which is not shown in these drawings for clarity purposes only. FIG. 11B is a section along line B-B of FIG. 11A, and shows the external more rounded shape as well as the internal shape defined by internal cavity 133. FIG. 11C is a horizontal section along line C-C of FIG. 11A, similar to that of FIG. 9. In this embodiment the I-beam truss structure appears on the inside surface of the bulb. It is created by the shape of the core pin used in molding the nipple. The result is a varying bulb wall thickness particularly in the upper half of the bulb to create the truss shape inside of the more rounded exterior. This provides generally the same function of support against the top of the palate as do the previous embodiments, but accomplished more internally than the others.

Figure 12A:
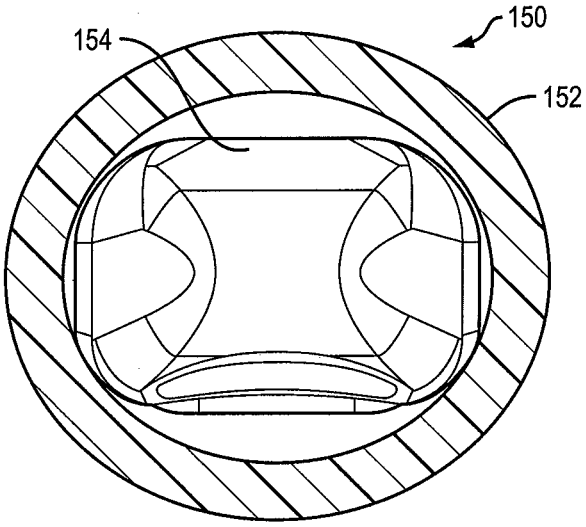
FIGS. 12A and 12B are vertical sections through another embodiment from the base looking toward the tip, similar to the views of FIGS. 7A and 7C.
Figure 12B:
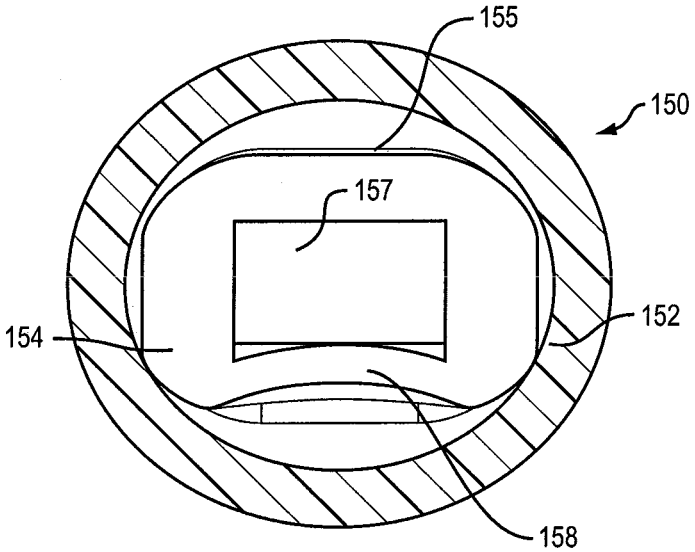

FIGS. 12A and 12B are vertical sections through another embodiment of a nipple 150, at different distances from the base looking toward the tip, similar to the views of FIGS. 7A and 7C. This is another example similar to that of FIG. 11 in which the support is accomplished more internally to allow a rounder outside shape to accomplish a more normal outward appearance for an orthodontic pacifier. Nipple 150 includes base 152 and bulb 154. Rounder external shape 155, central hollow core 157 (created via a pin) and tongue pad 158 are shown.

Figure 13:
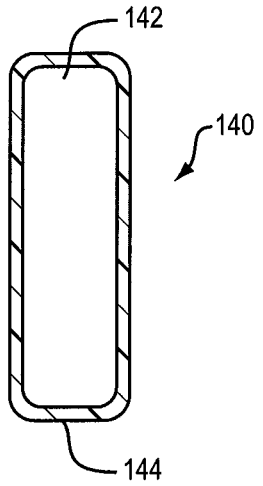
FIG. 13 is a simplified cross section through an alternative construction of a shield.

FIG. 13 is a simplified cross section through an alternative construction of pacifier shield 140. Hard plastic ring 142 is overmolded with a soft silicone or equivalent material 144. The structure of the harder interior allows for more contour to the shield and also more open areas for venting the skin and cheeks.

Figure 14:
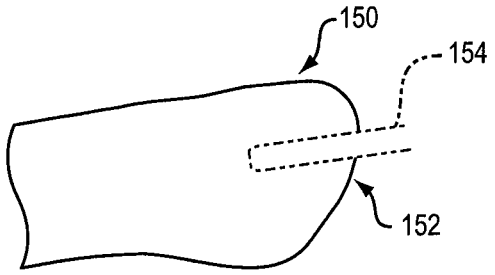
FIG. 14 shows an embodiment with an open tip, to allow the insertion and removal of devices such as medical devices.

FIG. 14 shows bulb 150 in which tip 152 is open to allow the insertion and removal of devices such as medical devices. For example, an intubation tube 154 can be fitted into the infant through the bulb, as can other tools or instruments. Alternatively, space for an intubation tube or other device, tool or instrument can be accomplished with a longitudinal groove in dorsal surface 50.

Although certain features are shown together in several of the drawings, this is not a limitation of the invention, as all features need not be included in all embodiments. Also, the dimensions in the drawings illustrate certain embodiments but are not limitations of the invention.

The following claims illustrate certain aspects of the invention to be claimed, but are not exhaustive and do not set forth the full scope of the invention.

The invention claimed is:

1. A pacifier, comprising:

a shield having first and second opposing shield sides: and a hollow bulb that projects from the first shield side, the bulb having a length, a width, a central longitudinal axis, a base where the bulb projects from the first shield side, and a distal end;

wherein a cross-section of the bulb has eight sides, the sides comprising a top, two opposing lateral surfaces, two upper angled lengths, a bottom opposing the top, and two lower angled lengths;

wherein each upper angled length connects one of the opposing lateral surfaces to the top, and each lower angled length connects one of the opposing lateral surfaces to the bottom; and wherein the bottom of the bulb defines a concave depression near the distal end but not reaching to the distal end, to guide and train the tongue during swallowing.

2. The pacifier of claim 1 wherein near the distal end a cross-section of the bulb has four sides, the four sides comprising the top, the bottom opposing the top, and the two opposing lateral surfaces, wherein each lateral surface connects the top to the bottom.

3. The pacifier of claim 2 wherein the central longitudinal axis is between the opposing lateral surfaces along most of the length of the bulb.

4. The pacifier of claim 3 wherein the width of the bulb increases from the base toward the distal end.

5. The pacifier of claim 4 wherein the bulb is widest close to the distal end.

6. The pacifier of claim 5 wherein the connection between the top and each upper angled length defines an obtuse angle which changes along the length of the bulb.

7. The pacifier of claim 6 wherein the bulb has a tip at the distal end and further defines inwardly-directed anterior lateral tip surfaces that connect both lateral surfaces to the tip.

8. The pacifier of claim 7 wherein the anterior lateral tip surfaces are slightly convex.

9. The pacifier of claim 1 wherein the shield has a generally planar face and the pacifier further comprises a raised pedestal between the generally planar face of the shield and the bulb, where the pedestal defines an outward face to which the bulb is coupled and that is angled relative to the generally planar face of the shield, so as to angle the central longitudinal axis relative to the face of the shield.

10. The pacifier of claim 9 wherein the central longitudinal axis of the bulb is angled from 82 to 85 degrees to the face of the shield.

11. The pacifier of claim 1 wherein the shield has an area below the bulb, and that area is more flexible than other areas of the shield.

12. The pacifier of claim 11 wherein the flexibility of the area of the shield is imparted at least in part by a thinning of the shield in that area.

13. The pacifier of claim 12 wherein the thinning is accomplished with an arc-shaped depression in the shield.

14. The pacifier of claim 1 further comprising a flexible handle that collapses or bends if a child rolls onto it, to help prevent a choking hazard while maintaining an open airway.

15. The pacifier of claim 1 where the tip of the bulb is open and designed to be interference fit with an intubation tube or other tool or instrument.

16. A pacifier, comprising:

a shield having first and second opposing shield sides; and a hollow bulb that projects from the first shield side, the bulb having a length, a width, a central longitudinal axis, a base where it projects from the first shield side, and a distal end;

wherein a cross-section of the bulb has eight sides, the sides comprising a top, two opposing lateral surfaces, two upper angled lengths, a bottom opposing the top, and two lower angled lengths; and wherein each upper angled length connects one of the opposing lateral surfaces to the top, and each lower angled length connects one of the opposing lateral surfaces to the bottom;

wherein the central longitudinal axis is between the opposing lateral surfaces along most of the length of the bulb;

wherein the bottom surface of the bulb defines a concave depression near the distal end but not reaching to the distal end, to guide and train the tongue during swallowing;

wherein the width of the bulb increases from the base toward the distal end;

wherein the bulb is widest close to the distal end;

wherein the connection between the top and each upper angled length defines an obtuse angle which changes along the length of the bulb;

wherein the bulb has a tip at the distal end and further defines inwardly-directed anterior lateral tip surfaces that connect both lateral surfaces to the tip;

wherein the anterior lateral tip surfaces are slightly convex;

wherein the shield has a generally planar face and the pacifier further comprises a raised pedestal between the generally planar face of the shield and the bulb, where the pedestal defines an outward face to which the bulb is coupled and that is angled relative to the generally planar face of the shield, so as to angle the central longitudinal axis relative to the face of the shield; and wherein the central longitudinal axis of the bulb is angled from 82 to 85 degrees to the face of the shield.

17. The pacifier of claim 16 wherein near the distal end the cross-section of the bulb has four sides, the four sides comprising the top, the bottom opposing the top, and the two opposing lateral surfaces, wherein each lateral surface connects the top to the bottom.

* * * * *